US007972026B2

(12) United States Patent
Warner et al.

(10) Patent No.: US 7,972,026 B2
(45) Date of Patent: Jul. 5, 2011

(54) LIGHT POLE BASE COVER

(75) Inventors: Gregory L. Warner, Lynchburg, OH (US); Andrew J. Bankemper, California, KY (US); Brian J Orth, Cincinatti, OH (US); James D Francis, New Vienna, OH (US)

(73) Assignee: LSI Industries, Inc., Cincinnati, OH (US)

( * ) Notice: Subject to any disclaimer, the term of this patent is extended or adjusted under 35 U.S.C. 154(b) by 373 days.

(21) Appl. No.: 12/248,157

(22) Filed: Oct. 9, 2008

(65) Prior Publication Data

US 2010/0091502 A1 Apr. 15, 2010

(51) Int. Cl.
*F21V 15/01* (2006.01)

(52) U.S. Cl. ..... 362/196; 362/362; 362/431

(58) Field of Classification Search ..... 362/196, 362/217.1, 217.12, 217.13, 362, 431
See application file for complete search history.

(56) References Cited

U.S. PATENT DOCUMENTS 3,256,428 A * 6/1966 Schwartz ..... 362/196
4,109,301 A * 8/1978 Wakimura ..... 362/363
4,460,947 A 7/1984 Kelly
4,490,776 A 12/1984 Kluch
4,599,684 A 7/1986 Lee
4,748,549 A 5/1988 Scheer
4,772,216 A 9/1988 Szymanek
4,847,741 A * 7/1989 Boettinger ..... 362/431
5,006,970 A 4/1991 Mackiewicz
5,014,170 A 5/1991 Gawad et al.
5,034,859 A 7/1991 Gawad et al.
5,371,661 A 12/1994 Simpson
5,564,815 A 10/1996 Littman et al.
5,568,680 A 10/1996 Parker
5,720,546 A 2/1998 Correll et al.
5,806,972 A 9/1998 Kaiser et al.
5,823,663 A 10/1998 Bell et al.
5,997,158 A 12/1999 Fischer et al.
6,027,230 A 2/2000 Huber et al.
6,050,710 A 4/2000 Grossman et al.
6,109,765 A 8/2000 Blanton
6,152,579 A 11/2000 Reed et al.
6,161,942 A 12/2000 Liu
6,210,025 B1 4/2001 Schmidt et al.

(Continued)

OTHER PUBLICATIONS

Snaplock Product Sheet, Fabricated Joints Without Welding, http://www.mate.com/pdf/SnapLock_PB.pdf, date of first publication not known, downloaded on Dec. 14, 2009.

(Continued)

*Primary Examiner* — Y My Quach Lee
(74) *Attorney, Agent, or Firm* — McDermott Will & Emery LLP

(57) ABSTRACT

Housings are described that include snap fittings or connections that can be placed on portions of the housing to allow assembly of the housing in the field, without the need for assembly tools or welding. Reduced assembly time and cost, as well as the reduction/elimination of tooling costs for assembly tools and/or associated hardware can therefore be realized. Exemplary embodiments of the present disclosure can include a snap fitting with first and second portions, e.g., male and female portions, including a portion having a tab or clip punched out of a sheet and including a holding protrusion or portion, and another portion having an aperture or depression configured and arranged to receive and be held by the holding portion. Preferred embodiments can be utilized as light pole base covers.

20 Claims, 4 Drawing Sheets

U.S. PATENT DOCUMENTS

| | | | | |
|---|---|---|---|---|
| 6,283,618 | B1 | 9/2001 | Fischer et al. | |
| 6,328,460 | B1 | 12/2001 | Grossman et al. | |
| 6,431,726 | B1 | 8/2002 | Barton | |
| 6,519,089 | B2 | 2/2003 | Graham | |
| 6,561,676 | B1 | 5/2003 | Fischer et al. | |
| 6,595,676 | B2 * | 7/2003 | Starry | 362/196 |
| 6,676,425 | B2 | 1/2004 | Lewis | |
| 6,719,434 | B1 | 4/2004 | Finn et al. | |
| 6,733,158 | B2 | 5/2004 | Fischer et al. | |
| 7,036,957 | B2 | 5/2006 | Paravantsos | |
| 2004/0151340 | A1 * | 8/2004 | Miller | 381/417 |
| 2006/0268559 | A1 | 11/2006 | Sferra et al. | |

OTHER PUBLICATIONS

Steel Round Poles, Product Sheet, LSI Industries, Inc., http://www.lsi-industries.com/media/specsheets/pdf/steelroundpoles_pet.pdf, 2 pages, Copyright 2007.

Product Tool, Wilson Tool, Form WD12444, http://www.wilsontool.com/pdf/prodLit/ZipTech_Prodbulletin.pdf, date of first publication not known, downloaded on Dec. 14, 2009.

W44 Installation and Assembly Instructions, LSI Industries, Inc., http://www.lsi-industries.com/media/5535/386454.pdf, date of first publication not known, downloaded on Dec. 14, 2009.

* cited by examiner

FIG. 3A
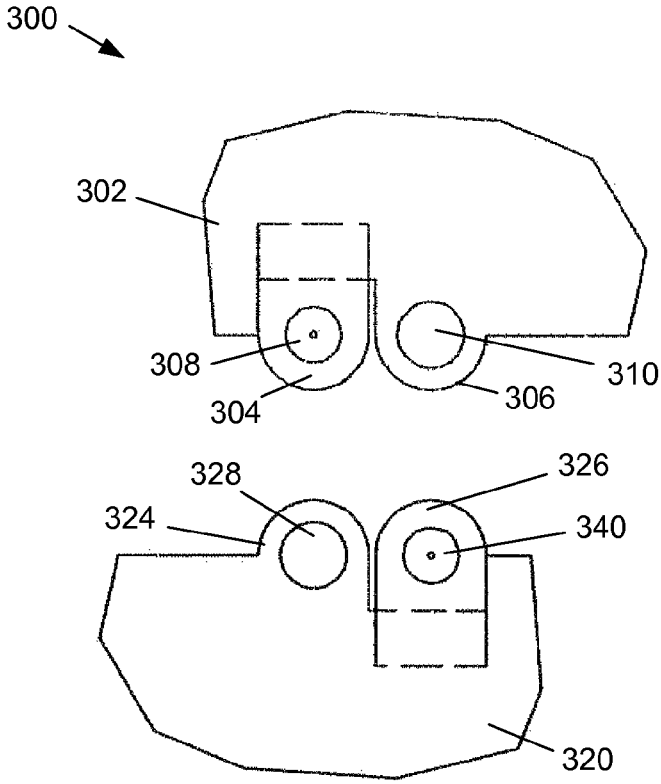
FIG. 3B
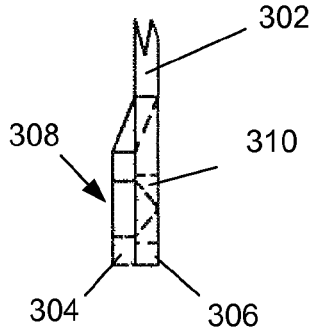
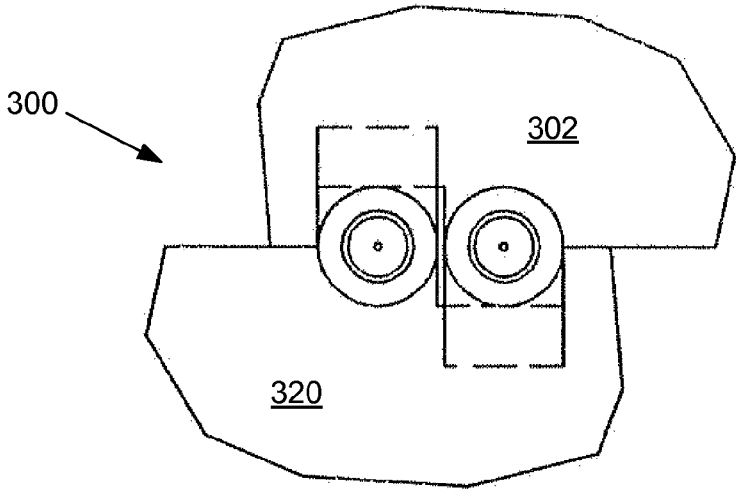
FIG. 3C

LIGHT POLE BASE COVER

FIELD OF THE DISCLOSURE

The present disclosure relates generally to housings, and more particularly to housings for lighting assemblies such as light poles, luminaires, and/or other light fixtures, and the like.

BACKGROUND OF THE DISCLOSURE

Manufacturers who ship assembled lighting fixture units for installation in industrial, commercial or residential settings often incur labor intensive assembly costs at the manufacturing and assembly plant, with the attendant result that the completed fixtures can be large and bulky. Packaging and shipping costs for the units can therefore be considered excessive. The manufacturers have therefore typically resorted to shipment separately of the fixture components or partially assembled units for assembly by the installation workers at the job site. However, the assembly, packaging and shipment separately of the housings for the light fixture units remain substantially labor intensive and costly for the manufacturer. There is therefore indicated a need for light fixture housings that can be inexpensively produced and shipped and which can be easily assembled on-site by the installation workers.

SUMMARY

The present disclosure overcomes the foregoing and other shortcomings and drawbacks of housings for luminaires, other light fixtures, and/or light poles by providing an easily assembled housing and methods of assembly of such housings, for which snap fit connections are utilized.

In accordance with the teachings of the present disclosure, snap fittings or connections can be placed on portions of a housing to allow assembly of the housing in the field, without the need for tools and/or hardware for assembly or the need for welding. Reduced assembly time and cost, as well as the reduction/elimination of tooling costs for assembly tools can therefore be realized.

Exemplary embodiments of the present disclosure can include a snap fitting with first and second portions, eggs, male and female portions, including a portion having a tab or clip punched out of a sheet and including a holding protrusion or portion, and another portion having an aperture or depression configured and arranged to receive and be held by the holding portion.

While aspects of the present disclosure are described herein in connection with certain embodiments, it is noted that variations can be made by one with skill in the applicable arts within the spirit of the present disclosure and the scope of the appended claims.

BRIEF DESCRIPTION OF THE DRAWINGS

Aspects and embodiments of the present disclosure may be more fully understood from the following description when read together with the accompanying drawings, which are to be regarded as illustrative in nature, and not as limiting. The drawings are not necessarily to scale, emphasis instead being placed on the principles of the disclosure. In the drawings:

FIGS. 3A, 3B, and 3C depict top, side, and assembled views of an embodiment having alternate snap fit connections.

Figure 1B:
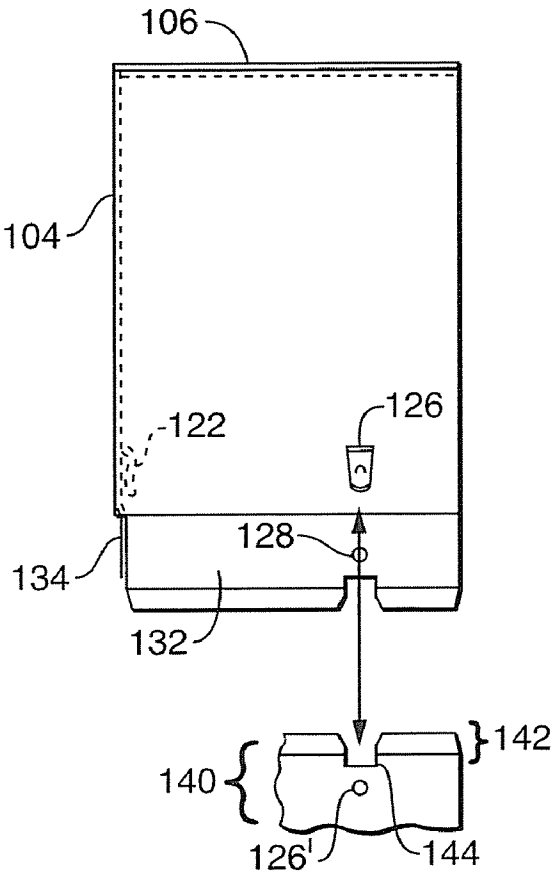
FIGS. 1A and 1B depict diagrammatic top and side views, respectively, of a portion of a housing in accordance with an exemplary embodiment of the present disclosure.

While certain embodiments are depicted in the drawings, the embodiments depicted are illustrative and variations of those shown, as well as other embodiments described herein, may be envisioned and practiced within the scope of the present disclosure.

DETAILED DESCRIPTION

Aspects and embodiments of the present disclosure provide housings that are easily assembled by personnel in the field without the need for any hardware, assembly tools, or welding for the assembly process. Additional benefits may be provided by eliminating/mitigating needs for machine tooling maintenance for assembly hardware. The housings can include snap fittings or other interlocking/intermeshing connections, thus eliminating any need for assembly tools and maintenance equipment/tooling for such tools.

Figure 1A:
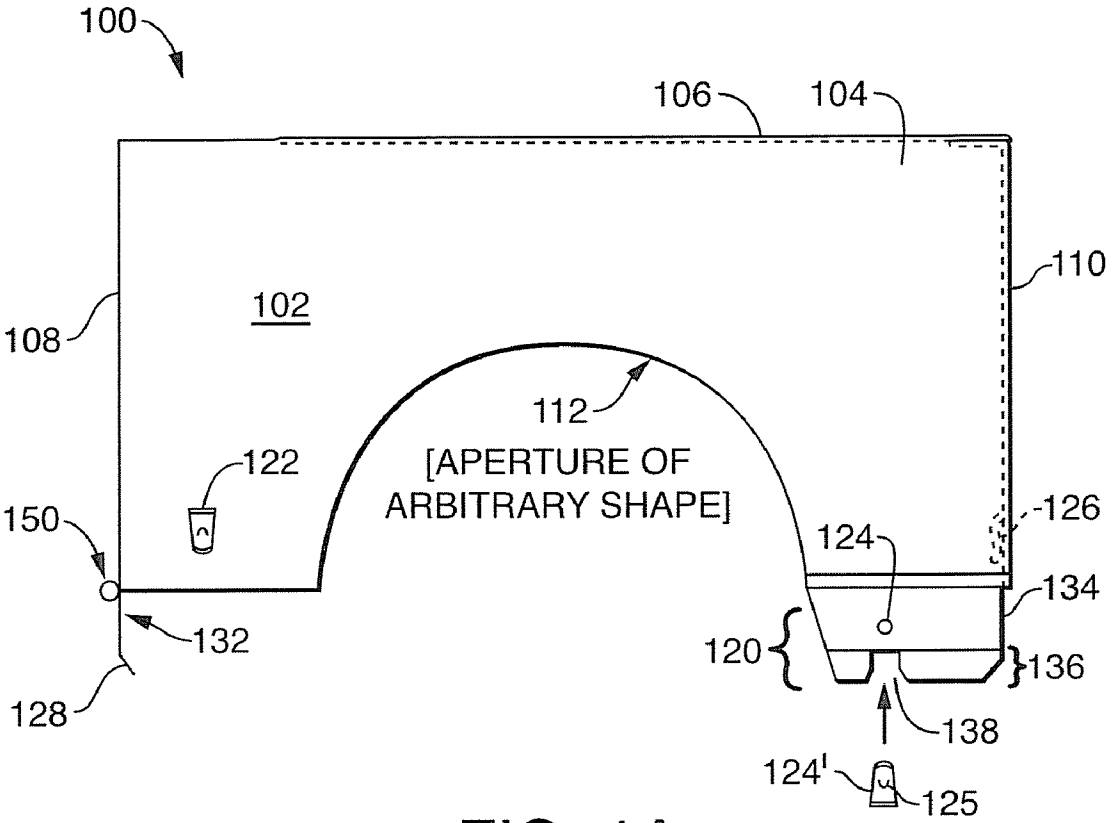

FIGS. 1A and 1B depict diagrammatic top and side views, respectively, of an embodiment 100 of a portion of a housing 102 in accordance with the present disclosure. Housing 100 can, for non-limiting example, be used to cover a base of a light pole. Housing component or part (erg, a housing half) 102 is shown in FIG. 1A as having a top 104, a back 106, and two sides 108 and 110. Top 104 can include a portion of an aperture 112 of arbitrary shape, e.g., one suitable for passing/admitting a light pole of desired configuration/shape. In practice, two housing component 102 would be fit together to form a complete housing or base cover, suitable for covering components such as a power supply, regulator, and/or driver circuit(s) or other desired components/circuits.

As shown in FIGS. 1A and 1B, housing component 102 can include a number of connections 120 including components or portions 122, 124, 126, and 128, which can be configured and arranged to fit or mate with complimentary portions 122', 124', 126', and 128' (only 124' and 126' are shown for clarity).

In exemplary embodiments, connection portions 122, 124, 126, and 128, and portions 122', 124', 126', and 128' can be snap fit connection components as shown in FIGS. 1A and 1B. These portions when connected to corresponding mating pieces or portions of another housing component (e.g., an identical housing component 102 rotated by 180 degrees) can form a number of locking connections 120, as indicated in FIG. 1A by the arrow from tab 124' showing the direction in which tab 124' would be received by hole 124 (and, when present, within cutout 138). In a locking connection 120, e.g., depression 125 on tab 124' would be received and held by hole 124. Such connections 120 accordingly do not require tools for assembly.

As shown in FIGS. 1A and 1B, exemplary embodiments can optionally have angled planes or tongues, e.g., 136 and 142, which can increase the ease of assembly of a housing. The tongues can include appropriately shaped cutouts, e.g., 138 and 144, to receive the corresponding tab, e.g., 124' in FIG. 1A and 126 in FIG. 11B.

In alternate embodiments, a hinge 150 may be provided to a housing to facilitate installation. For such embodiments, snap fit connections are not necessary for the adjacent portions of the housing, thus reducing the number of snap fittings required. For certain applications/embodiments employing hinges, features of the hinges may render the pieces/portions of the housing asymmetrical (whereas embodiments without hinges are/can be symmetrical, thus possibly increasing manufacturing costs.

Exemplary embodiments may utilize any of the following materials for the housing and/or connection parts: aluminum, pre-painted aluminum, cold roll steel, hot roll steel, hot roll steel-pickled and oiled, galvanized steel, galvannealed steel, paint grip steel, pre-painted steel, and/or stainless steel. Any suitable finish (e.g., paint or powder coat, etc.) may be used for the housing parts/portions.

Figure 2A:
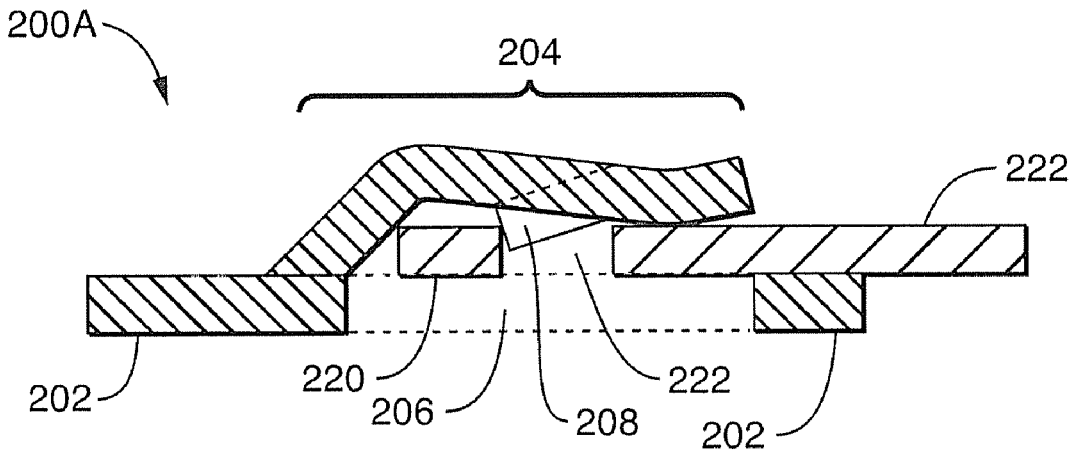
FIGS. 2A and 2B depict a cross section view and a perspective view, respectively, of exemplary embodiments of snap fit structures in accordance with the present disclosure.
Figure 2B:
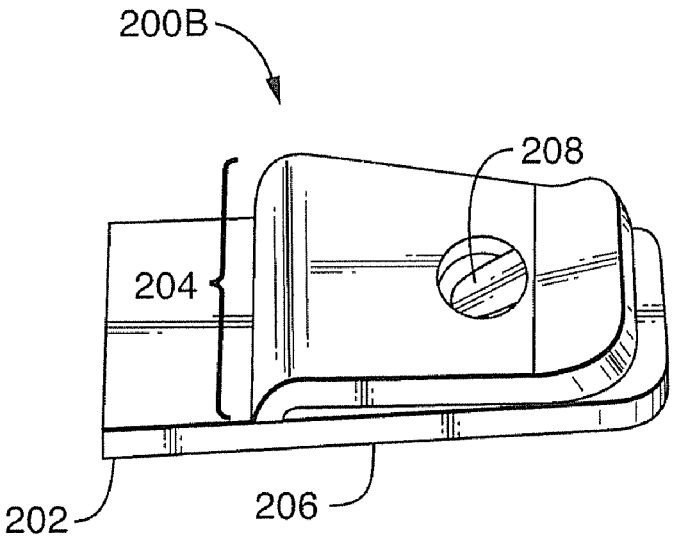

FIGS. 2A and 2B depict a cross section view and a perspective view, respectively, of exemplary embodiments 200A and 200B of snap fit connections or structures in accordance with the present disclosure.

As shown in FIG. 2A, a first sheet (or part) 202 of suitable material (e.g., desired metal) is connected to a second sheet (or part) 220. First sheet 202 can include a tab 204 having a depression 208 that can be used for connection to a receiving component, which for the embodiment shown is indicated by aperture 222 in second sheet 220. With reference to FIGS. 2A and 2B, while the term "sheet" has been used for 202 and 220, this term is merely by way of example, and is not intended to be limiting. In the depicted embodiment, the tab 204 is formed out of the material of the first sheet 202 leaving aperture 206.

FIGS. 3A, 3B, and 3C depict top, side, and assembled top views, respectively, of an embodiment 300 with an alternate snap fit connection between two housing material parts 302 and 320. As shown in FIG. 3A, an alternate embodiment of a snap fit connection can include a first (or offset) tab 304 that is offset from a form 302 or sheet of material (e.g., one utilized as a housing portion). FIG. 3B depicts a side view of the connection of FIG. 3A, with the offset nature of tab 304 and sheet 302 being readily apparent.

Each offset tab (e.g., tab 304) includes a dimple (e.g., dimple 308) that protrudes from the tab in a direction toward the parent form or sheet. The connection includes one or more adjacent second (in-line or hole) tabs 306 (one is shown) with a hole 310, connected to the parent form or sheet 302. FIG. 3A shows that part 320 includes complimentary tabs 324 and 326 (to tabs 304 and 306 of part 302) with hole 328 and dimple 340, respectively. When parts 302 and 320 are fit together, dimples 308 and 310 are received by holes 328 and 340, respectively, as shown in FIG. 3C.

In will be understood that, with regard to pieces 302 and 320, while each is shown with a single offset tab and an adjacent in-line tab, that any number of such offset and in-line tabs may be used for a connection. For example, two in-line tabs could flank a single offset tab; the corresponding mating piece would consequently have two offset tabs and a single in-line tab. For additional, and non-limiting example, each mating housing piece could include two offset tabs and two in-line tabs for a connection. While less preferred, a connection could also include a single in-line tab on one piece and a single offset tab on the mating piece. Other configurations and/or numbers of such tabs can be used as desired.

Figure 4:
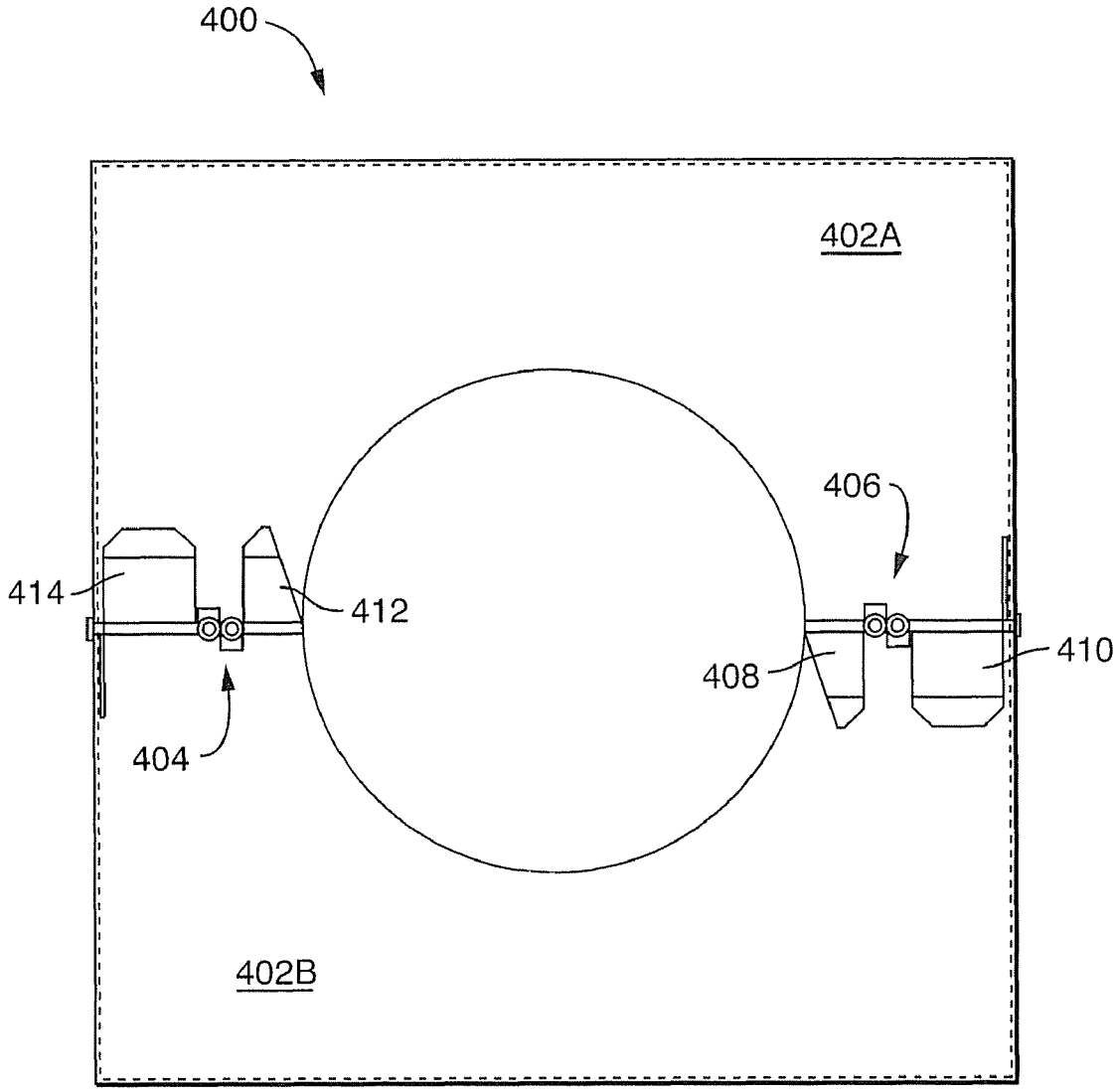
FIG. 4 depicts a top perspective view of an assembled housing utilizing snap fit connections according FIGS. 3A-3C.

FIG. 4 depicts a top perspective view of an assembled housing 400 having major parts 402A-402B and also utilizing snap fit connections 404 and 406 according FIGS. 3A-3C. As indicated, the housing 400 may optionally include one or more apertures (similar to the housing of FIG. 1) of desired shape. As shown, tabs (e.g., tabs 408, 410, 412, and 414) may optionally be present to facilitate connection between parts 402A-402B.

With continued reference to FIG. 4, it should be noted that while connections 404 and 406 are each shown as having just two interlocking tabs (employing the hole and dimple configuration shown in FIGS. 3A-3C), each such connection can have more than two tabs. Such additional tabs might be desirable for, e.g., increased rigidity of the connection or housing.

Exemplary embodiments of the present disclosure can utilize interlocking connections in which a tab or tongue has been pinch-pressed out of a sheet of metal; this tab can be displaced by a desired distance from the parent sheet of metal. The tab can be configured and arranged to have a desired angle or angles between the parent sheet. In exemplary embodiments, the tab can have a dimple or depression/protrusion that can fit within a depression or aperture, e.g., hole, in a mating piece. In exemplary embodiments, SNAPLOCK™ fabricated joints made commercially available by Mate Precision Tooling Inc, with business offices at 1295 Lund Blvd., Anoka, Minn. 55303, USA, can be used for snap fit connections in accordance with the present disclosure.

Accordingly, the connections afforded by embodiments of the present disclosure can allow different types of materials (e.g., different metals, plastics) to be joined. The joined materials can have different thickness. Welding is not necessary, and no tools are necessary for assembly.

While certain embodiments have been described herein, it will be understood by one skilled in the art that the methods, systems, and apparatus of the present disclosure may be embodied in other specific forms without departing from the spirit thereof. For example, while aspects and embodiments herein have been described in the context of sheets when referring to the housing portions, other materials and structures may of course be realized and utilized within the scope of the present disclosure. Such housing portions are not limited to thin materials and may be of a desired thickness and/or materials) suitable for a housing.

Additionally, while the housings described herein have largely been referred to in the context of light fixture housings, the present disclosure is not limited to such, and can be used to provide housings to many other items, systems, assemblies, and spaces as desired. Further, while the housing portions have been described in the context of including one or more apertures to receive the base of a light pole, such housing may be configured and utilized for virtually any covering purpose or to contain or protect most anything. And, while metals have been described for the housing materials, the present disclosure can include use of other suitably rigid and strong or durable materials such as plastics and/or composites (e.g., fiberglass), etc.

Accordingly, the embodiments described herein, and as claimed in the attached claims, are to be considered in all respects as illustrative of the present disclosure and not restrictive.

What is claimed is:

1. A pole base cover housing comprising:

a first housing portion having a mating edge and a second housing portion having a mating edge, the first and second housing portions configured and arranged to fit to one another along their mating edges;

the first housing portion defining a portion of a pole aperture and the second housing portion defining a portion of a pole aperture such that when the first and second housing portions are fitted to one another along their mating edges, the first and second housing portions define at least a portion of a pole aperture;

the first housing portion further comprising a tab located a predetermined distance inward from the mating edge of the first housing portion, the tab extending from the first housing portion to define a proximate end and a distal end, the tab comprising a depression proximate to the distal end; and the second housing portion comprising a tongue extending from the mating edge of the second housing portion, the tongue defining a hole located approximately the predetermined distance from the mating edge of the second housing portion;

wherein the tab depression and hole are configured to form a snap fit connection, when engaged, to hold the first and second housing portions together.

2. The housing of claim 1, wherein the the tab is connected to and offset from the first housing portion.

3. The housing of claim 1, wherein the tab is formed from the material of the first housing portion.

4. The housing of claim 1, wherein the housing comprises a sheet material selected from the group consisting of metals, metal alloys, and plastics.

5. The housing of claim 1, wherein a housing portion includes at least one opening defined therein for receiving electrical power supply wiring.

6. The housing of claim 1, further comprising a hinge connecting two of the housing portions.

7. The housing of claim 1, the tongue further defining a cutout adjacent to the hole.

8. A method for making a pole base cover housing, comprising:

providing a first housing portion having a mating edge and a second housing portion having a mating edge, the first and second housing portions configured and arranged to fit to one another along their mating edges;

providing the first housing portion with a portion of a pole aperture and the second housing portion with a portion of a pole aperture such that when the first and second housing portions are fitted to one another along their mating edges, the first and second housing portions define at least a portion of a pole aperture;

providing the first housing portion with a tab located a predetermined distance inward from the mating edge of the first housing portion, the tab extending from the first housing portion to define a proximate end and a distal end, the tab comprising a depression proximate to the distal end;

providing the second housing portion with a tongue extending from the mating edge of the second housing portion, the tongue defining a hole located approximately the predetermined distance from the mating edge of the second housing portion; and connecting the first and second housing portions, wherein the hole receives the tab depression forming a connection between at least two of the housing portions.

9. The method of claim 8, further comprising providing a hinge between two or more of the housing portions.

10. The method of claim 8, wherein the the tab is connected to and offset from the first housing portion.

11. The method of claim 8, wherein the tab is formed from the material of the first housing portion.

12. The method of claim 8, wherein no assembly tools are used for connecting the two or more housing portions.

13. The method of claim 8, wherein no welding is used for connecting the two or more housing portions.

14. A pole base cover housing comprising:

a first housing portion having a mating edge and a second housing portion having a mating edge, the first and second housing portions configured and arranged to fit to one another along their mating edges;

the first housing portion defining a portion of a pole aperture and the second housing portion defining a portion of a pole aperture such that when the first and second housing portions are fitted to one another along their mating edges, the first and second housing portions define a pole aperture;

the first housing portion further comprising a first tab located at the mating edge of the first housing portion, the first tab comprising a depression, the first housing portion further comprising a second tab located at the mating edge of the first housing portion and adjacent to the first tab, the second tab defining a hole; and the second housing portion further comprising a third tab located at the mating edge of the second housing portion, the third tab comprising a depression, the second housing portion further comprising a fourth tab located at the mating edge of the second housing portion and adjacent to the third tab, the second tab defining a hole;

wherein, the housing is configured such that the depression of the first tab forms a snap fit connection with the hole of the fourth tab when engaged and the depression of the third tab forms a snap fit connection with the hole of the second tab when engaged.

15. The housing of claim 14, wherein the first tab is offset from the first housing portion and the third tab is offset from the second housing portion.

16. The housing of claim 14, wherein the first tab is immediately adjacent to the third tab.

17. The housing of claim 14, wherein the housing comprises a material selected from the group consisting of metals, metal alloys, and plastics.

18. The housing of claim 14, wherein a housing portion includes at least one opening defined therein for receiving electrical power supply wiring.

19. The housing of claim 14, further comprising a hinge connecting two of the housing portions.

20. The housing of claim 14, the first and second housing portions are comprised of sheet metal.

* * * * *